US005370365A

United States Patent [19]

Kuretich

[11] Patent Number: 5,370,365

[45] Date of Patent: Dec. 6, 1994

[54] ARTICULATED FLAT PLATE ERECTING TOOL

[76] Inventor: Stephen Kuretich, 2045 Vigilante Ave., Bailey, Colo. 80421

[21] Appl. No.: 201,857

[22] Filed: Feb. 25, 1994

[51] Int. Cl.[5] ..... B66F 11/00

[52] U.S. Cl. ..... 254/119; 254/131

[58] Field of Search ..... 254/113, 116, 119, 120–123, 254/131, 131.5, 132, 129, 133, 134; 14/71.3; 414/457; 294/82.1

[56] References Cited

U.S. PATENT DOCUMENTS 5,154,399 10/1992 Swanson .
5,161,292 11/1992 Kurtyak et al. .
5,176,363 1/1993 Bowlin .
5,181,694 1/1993 Collins .
5,292,107 3/1994 Chick ..... 254/131

*Primary Examiner*—Robert C. Watson
*Attorney, Agent, or Firm*—John R. Flanagan

[57] ABSTRACT

An erecting tool for converting an articulated flat plate from a folded storage condition to a flat deployed condition, includes an elongated main lever, an extension arm, a hook member and an auxiliary lever. The main lever is adapted to be placed at and pivoted about a stationary location on a dock toward and away from the articulated flat plate. The extension arm is rigidly attached to and extends outwardly in a cantilevered transverse relationship from a lower portion of the main lever. The hook member has an upper end pivotally coupled to the outer end of the extension arm such that the hook member extends below the extension arm. The hook member also has an outer end shaped to hook under an outer edge of the articulated flat plate and to begin lifting the plate upon pivoting the main lever in a rearward direction. The auxiliary lever is pivotally attached to the extension arm adjacent to and inwardly from the hook member. The auxiliary lever is depressable and the main lever and extension arm therewith are pivotal toward the articulated flat plate such that the hook member causes forward extension of the articulated flat plate and thereby conversion of the articulated flat plate from the folded storage condition to the flat deployed condition.

17 Claims, 2 Drawing Sheets

ARTICULATED FLAT PLATE ERECTING TOOL

BACKGROUND OF THE INVENTION

1. Field of the Invention

The present invention generally relates to tools for use in installing, removing, raising and/or lowering various kinds of workpieces and, more particularly, is concerned with an erecting tool for lifting and extending an articulated flat plate, such as used at a truck loading and unloading dock, from a partially folded storage condition to a flat deployed condition.

2. Description of the Prior Art

A typical truck dock at a commercial or industrial facility is a platform located above the ground at a standard elevation or height matching that of a truck bed above the ground. For loading and unloading purposes, a truck is backed up to the dock until the rear end of the bed of the truck makes contact with bumpers protruding from the dock. The rear end of the truck bed is then spaced a short distance from the front edge of the dock, creating a gap therebetween which has to be bridged in order to safely and efficiently load or unload goods to or from the truck bed.

A widespread practice is to provide an articulated flat plate which is extendable between the dock and truck bed over the gap. The articulated plate is pivotally connected by a first hinge to a flat mounting plate attached vertically to the front edge of the dock. The articulated plate also has a second hinge pivotally connecting a pair of flat front and rear portions of the plate along a line extending generally parallel to and spaced approximately midway between front and rear edges of the plate. The first hinge is disposed along the front edge of the dock and constructed to limit the rear portion of the articulated plate to pivotal movement upwardly away from and downwardly toward a generally horizontal orientation relative to the vertically-oriented flat mounting plate in which the rear portion of the articulated plate projects outwardly from the front edge of the dock. The second hinge is spaced forwardly from the first hinge and thereby from the front edge of the dock and is constructed to allow the front portion of the articulated plate to normally hang vertically downward from the second hinge and the rear portion of the articulated plate.

The second hinge is also constructed to allow the flat front and rear portions of the articulated plate to only pivot through approximately 180° relative to one another between a fully extended relationship and a one-way folded relationship. In the fully extended relationship, the front portion of the articulated plate is angularly displaced generally 180° from the rear portion of the plate. Thus, the flat front and rear portions of the plate are oriented in a substantially coplanar relationship with one another which converts the articulated plate to a generally flat deployed position in which it is capable of spanning the gap between the dock and truck bed. In a partially folded relationship, in which the front and rear portions of the articulated plate are disposed approximately halfway between the fully extended and one-way folded relationships, the front portion of the articulated plate is disposed at an angle about midway between 0° to 180°, or about 90°, relative to the rear portion of the plate which places the articulated plate in a partially folded storage condition in which the front portion of the plate hangs downwardly from the front edge of the rear portion of the plate.

To convert the articulated plate from the partially folded storage condition to the fully extended or flat deployed condition, the conventional practice is for a dock worker to use a meat-type hook. The dock worker has to bend over the front edge of the dock and reach down and engage the lower front edge of the front portion of the articulated plate with the hook. While still in the bent-over position, the dock worker then has to pull upwardly to lift both portions of the articulated plate and to pivot the front portion of the plate relative to the rear portion thereof in order to convert the articulated plate to the fully extended deployed condition.

It can be easily realized that such practice can frequently cause back strain and injury to the dock worker and result in a workman's compensation claim. Consequently, a need exists for a tool to assist a dock worker in converting the articulated plate from the partially folded storage condition to the fully extended or flat deployed condition so as to avoid the problems of the above-described prior art practice.

SUMMARY OF THE INVENTION

The present invention provides an erecting tool designed to satisfy the aforementioned needs in that the erecting tool is used for lifting and extending the articulated flat plate from the partially folded storage condition to the flat deployed condition. The dock worker, while standing substantially erect, can employ the erecting tool to hook the lower edge of the front portion of the articulated plate and pull backwardly thereon to lift both front and rear portions of the articulated plate in order to convert the articulated plate from the partially folded storage condition to the flat deployed condition. Thus, the conventional practice will now be carried out with the assistance of the erecting tool, instead of the meat-type hook, without the need for the dock worker to bend over and risk back strain and injury.

Accordingly, the present invention is directed to an erecting tool for converting an articulated flat plate from a partially folded storage condition to a flat deployed condition. The erecting tool basically includes an elongated main lever, an extension arm, a hook member and an auxiliary lever. The main lever is adapted to be placed at and pivoted about a stationary location on a support structure toward and away from the articulated flat plate. The extension arm is rigidly attached to and extends outwardly in a cantilevered transverse relationship from a lower portion of the main lever. The hook member has an upper end pivotally coupled to the outer end of the extension arm such that the hook member extends below the extension arm. The hook member also has an outer end shaped to hook under an outer edge of the articulated flat plate and to begin lifting the plate upon pivoting of the main lever in a rearward direction. The auxiliary lever is pivotally attached to the extension arm adjacent to and inwardly from the hook member. The auxiliary lever is depressable and the main lever and extension arm therewith are pivotal toward the articulated flat plate such that the hook member causes forward extension of the articulated flat plate and thereby conversion of the articulated flat plate from the folded storage condition to the flat deployed condition.

More particularly, main lever includes an elongated rigid member having a hand grip installed over an upper end thereof and a cup-shaped slip resistant element installed over a lower end thereof. Also, the auxiliary lever includes first and second leg portions rigidly attached to one another and extending in a transverse relationship with one another. The second leg portion is pivotally connected to the extension arm. The user's foot is employed to depress the first leg portion such that an elbow of the auxiliary lever formed by the rigidly connected first and second leg portions is brought into engagement with the rear portion of the articulated flat plate.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
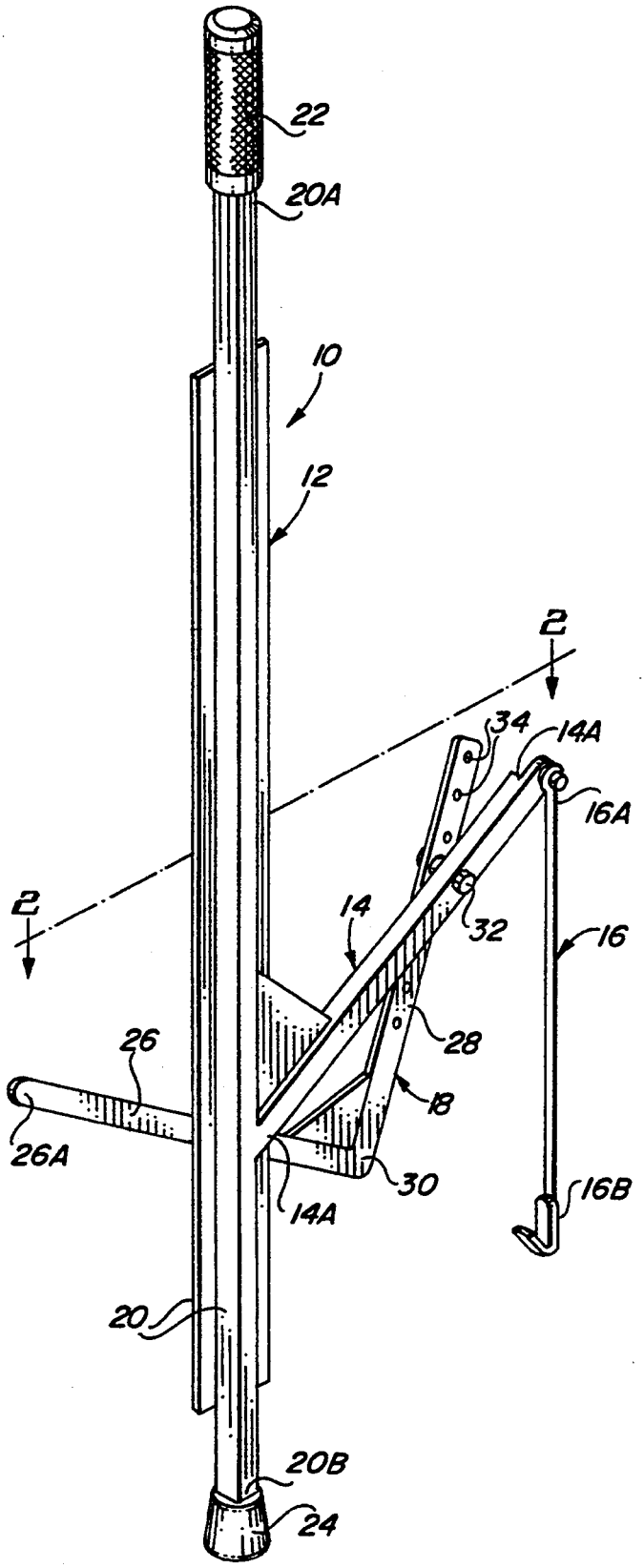
FIG. 1 is a perspective view of an erecting tool of the present invention which is used in lifting and extending an articulated flat plate, such as employed at a truck loading and unloading dock.
Figure 2:
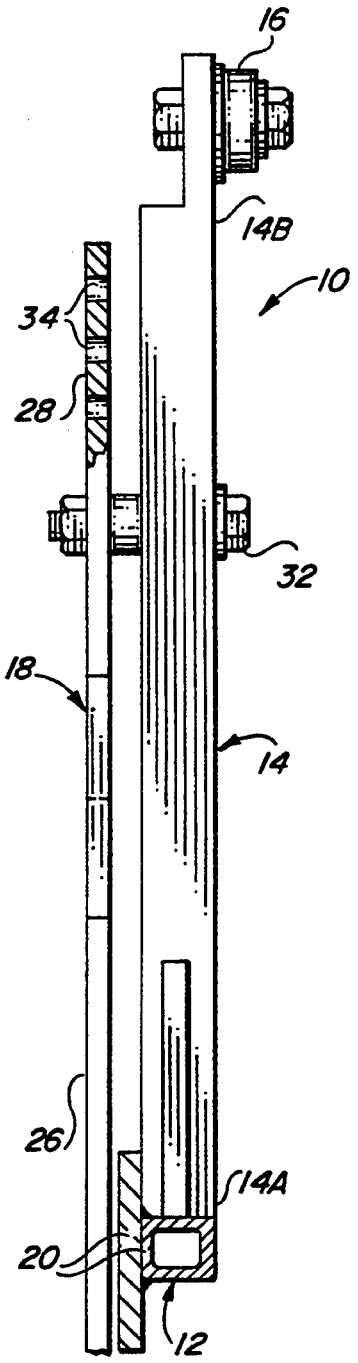
FIG. 2 is an enlarged top plan view, partly in section, of the erecting tool as seen along line 2—2 of FIG. 1.
Figures 3A, 3B, 3C, 3D, 3E, 3F, 3G:
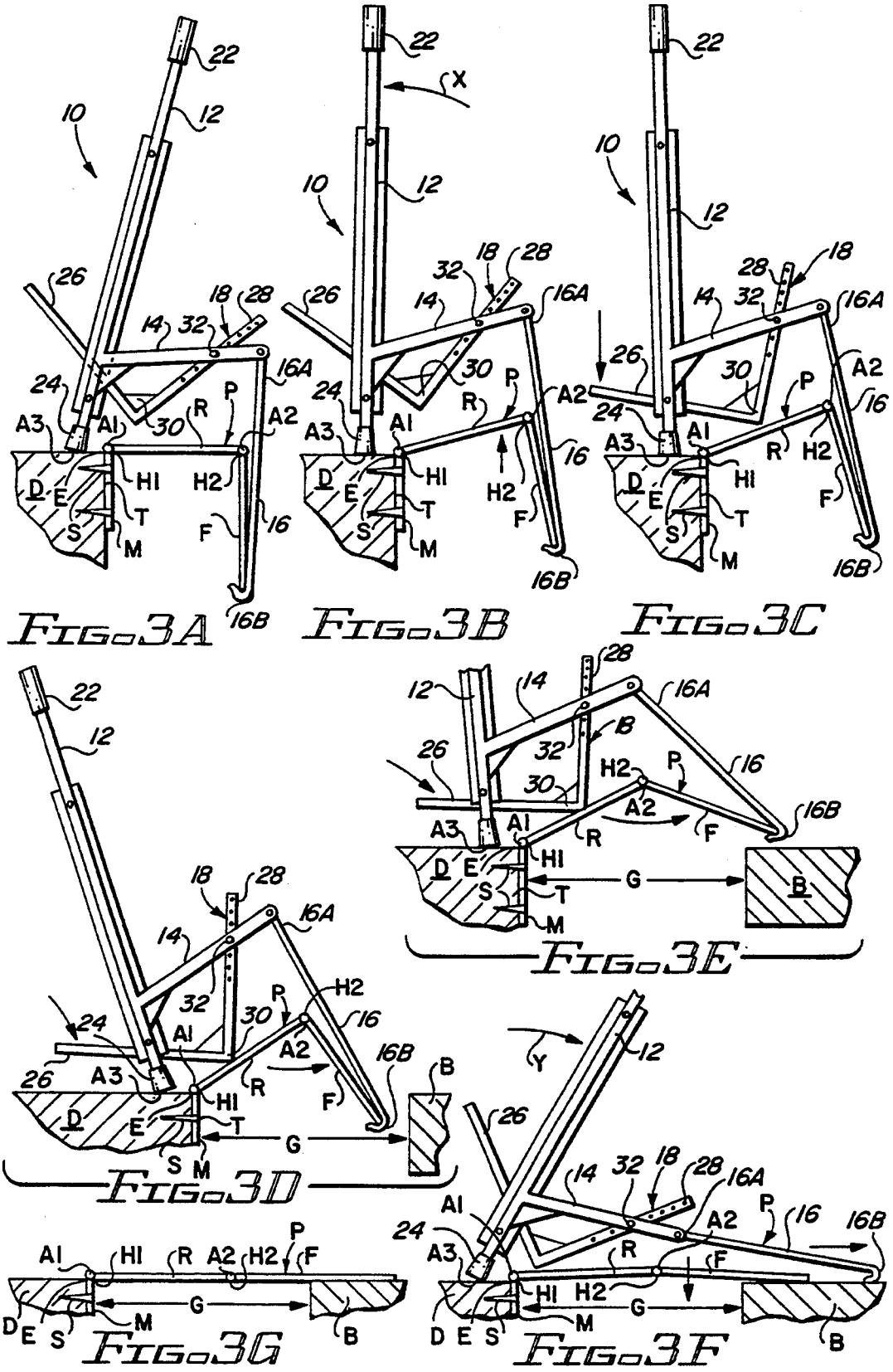
FIGS. 3A through 3G are side elevational views showing a sequence of steps followed in using the erecting tool of the present invention to lift and extend the articulated flat plate from the partially folded storage condition to the fully extended flat deployed condition.

Referring to the drawings, and particularly to FIGS. 1, 3A and 3F, there is illustrated an erecting tool of the present invention, generally designated 10. The erecting tool 10 is used by a dock worker to convert an articulated flat plate P, typically employed at a truck loading and unloading dock D, from a partially folded storage condition, as shown in FIG. 3A, to a fully extended flat deployed condition, as shown in FIG. 3F, in which the articulated flat plate P is extended over a gap G between the dock D and the rear end of a truck bed B.

As seen in FIGS., 3A through 3G, the articulated plate P is pivotally connected by a first hinge H1 to a mounting plate M attached by suitable fasteners S in a vertical orientation on the front surface T of the dock D extending downwardly below the front edge E thereof. The articulated plate P includes flat front and rear portions F, R and a second hinge H2 pivotally connecting the front and rear portions F, R of the plate P along a line extending generally parallel to and spaced approximately midway between front and rear edges of the plate P. The first and second hinges H1, H2 define respective first and second horizontal pivotal axes A1, A2 which extend parallel to one another. The first hinge H1 is disposed along the front edge E of the dock D and is constructed in a conventional known manner to limit the rear portion R of the articulated plate P to pivotal movement upwardly away from and downwardly toward a generally horizontal orientation relative to the vertically-oriented flat mounting plate in which the rear portion R of the articulated plate P projects outwardly from the front edge E of the dock D. The second hinge H2 is spaced forwardly from the first hinge H1 and thereby from the front edge E of the dock D and is constructed in a conventional known manner to allow the front portion F of the articulated plate P under the force of gravity to normally hang vertically downward from the second hinge H2 and the front edge of the rear portion R of the articulated plate P. The second hinge H2 is also constructed in a conventional known manner so as to allow the flat front and rear portions F, R of the articulated plate P to only pivot through approximately a maximum of 180° relative to one another between a fully extended flat or coplanar relationship with one another, as shown in FIG. 3G, and a one-way folded relationship (not shown). FIG. 3A shows the flat front and rear portions F, R of the articulated plate in a partially folded relationship with one another approximately midway between the fully extended and one-way folded relationships. In the fully extended relationship shown in FIG. 3A, the front portion F of the articulated plate P is angularly displaced generally 180° from the rear portion R thereof. Thus, in the fully extended relationship, the flat front and rear portions F, R of the plate P are oriented in a substantially coplanar relationship with one another which places the articulated plate P in the generally flat deployed condition, as seen in FIGS. 3F and 3G, in which it is capable of spanning the gap G between the dock D and truck bed B. In the partially folded relationship seen in FIG. 3A, the front portion F of the articulated plate P is disposed at an angle about midway between 0° to 180°, or about 90°, relative to the rear portion R of the plate P which places the articulated plate P in the partially folded storage condition in which the front portion F of the plate P hangs downwardly from the front edge E of the rear portion R of the plate P.

In accordance with the present invention, the erecting tool 10 is provided for use manually by the dock worker for converting the articulated flat plate P from the partially folded storage condition of FIG. 3A to the fully extended flat deployed condition of FIG. 3G. Basically, the erecting tool 10 includes an elongated main lever 12, an elongated extension arm 14 rigidly mounted to the main lever 12, an elongated hook 16 pivotally suspended from the extension arm 14, and an auxiliary lever 18 pivotally mounted to the extension arm 14.

The elongated main lever 12 of the erecting tool 10 includes an elongated rigid member 20 having a hand grip 22 installed over an upper end 20A of the rigid member 20 and a cup-shaped slip resistant element 24 installed over a lower end 20B of the rigid member 20. The main lever 12 is thereby adapted to be manually and removably placed and held at and pivoted about a stationary location on the dock D toward and away from the articulated flat plate P. As shown in FIGS. 3A through 3F, the slip resistant element 24 rests on the mounting strip S rearwardly of the first hinge H1 and the first horizontal axis A1 about which the rear portion R of the articulated flat plate P pivots relative to the mounting plate M and front surface T of the dock D. A third horizontal axis A3 about which the main lever 12 is manually pivoted by the dock worker extends in a substantially perpendicular relationship to a plane along which lie the opposite rearward and forward directions of pivoting of the main lever 12, being indicated respectively by arrow X in FIG. 3B and arrow Y in FIG. 3F. The third pivotal axis A3 also extend substantially parallel relationship to the first and second pivotal axes A1, A2 of the rear and front portions R, F of the articulated flat plate P.

The elongated extension arm 14 of the erecting tool 10 is rigidly attached to and extends outwardly in a cantilevered relationship from a lower portion of the main lever 12. More particularly, the extension arm 14 is rigidly attached at an inner end 14A to the rigid member 20 of the main lever 12 at a location thereon spaced above the lower end 20B thereof and extends outwardly in the cantilevered relationship therefrom to an outer end 14B.

The elongated hook member 16 of the erecting tool 10 is pivotally coupled at an upper end 16A to the outer end 14B of the extension arm 14. The hook member 16 extends downwardly below the outer end 14B of the extension arm 14 and has a lower end 16B shaped for hooking under an outer edge of the front portion F of the articulated flat plate P and for lifting the rear and front portions R, F thereof by pivoting the main lever 12 in the rearward direction of arrow X in FIG. 3B.

The auxiliary lever 18 of the erecting tool 10 is pivotally attached to the extension arm 14 adjacent to and inwardly from the upper end 16A of the hook member 16 and the outer end 14B of the extension arm 14. More particularly, the auxiliary lever 18 includes first and second leg portions 26, 28 rigidly attached to one another at an elbow 30 and extending in a transverse relationship with one another. The second leg portion 28 is pivotally connected to the extension arm 14 by a fastener 32. The second leg portion 28 has a series of spaced apertures 34 defined therein so as to allow selection the proper mounting relationship of the auxiliary lever 18 to the extension arm 14. A foot of the user is employed to step down on the inner end 26A of the first leg portion 26 of the auxiliary lever 18 and depress the auxiliary lever 18 such that an elbow 30 of the auxiliary lever 18 formed by the rigidly connected first and second leg portions 26, 28 thereof is brought into engagement with the rear portion R of the articulated flat plate P to facilitate forward extension of the articulated flat plate P.

Referring to FIGS. 3A through 3G, there is depicted the sequence of steps followed in using the erecting tool 10 of the present invention to convert the articulated flat plate P from the folded storage condition of FIG. 3A to the flat deployed condition of FIG. 3G. The sequence of steps are as follows.

First, as seen in FIG. 3A, the erecting tool 10 is placed at a stationary location on the dock D with the extension arm 14 extending outwardly in the cantilevered relationship from the main lever 12 and the lower end 16B of the hook member 16 hooking under the outer end of the front portion F of the articulated flat plate P.

Second, as seen in FIG. 3B, the main lever 12 is then manually pulled and pivoted in the rearward direction X causing the extension arm 14 to pivot upwardly and via the hook member 16 to begin lifting of the rear and front portions R, F of the articulated flat plate P.

Third, as seen in FIGS. 3C to 3D, the auxiliary lever 18 is manually depressed by the user's foot (not shown) to bring the elbow 30 of the auxiliary lever 18 into engagement with the rear portion R of the articulated flat plate P and thereby place the auxiliary lever 18 in position, once the articulated plate P is lifted above the level of the truck bed B, to facilitate forward extension of the articulated flat plate P toward the truck bed B.

Fourth, as seen in FIGS. 3E to 3F, by then further depressing the auxiliary lever 18 and pivoting the main lever 12 and extension arm 14 therewith in the forward direction Y, the hook member 16 causes pivoting of the front and rear portions F, R of the articulated flat plate P relative to one another from the partially folded relationship to the extended flat relationship which results in forward extension of the articulated flat plate P and thereby conversion of the articulated flat plate P from the folded storage condition of FIG. 3A to the flat deployed condition of FIG. 3G in which the articulated flat plate P bridges the gap G between the dock D and rear end of the truck bed B.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

I claim:

1. An erecting tool for use in converting an articulated flat plate from a partially folded storage condition to a flat deployed condition, said erecting tool comprising:

(a) an elongated main lever adapted to be placed at and pivoted about a stationary location on a support structure toward and away from the articulated flat plate;

(b) an extension arm rigidly attached to and extending outwardly from a lower portion of said main lever;

(c) a hook member having an upper end pivotally coupled to an outer end of said extension arm, said hook member extending therebelow and also having a lower end shaped to hook under an outer edge of the articulated flat plate and to begin lifting of the articulated flat plate upon pivoting of said main lever in a rearward direction; and (d) an auxiliary lever pivotally attached to said extension arm adjacent to and inwardly from said hook member, said auxiliary lever being depressable and said main lever and extension arm therewith being pivotal toward the articulated flat plate such that said hook member causes forward extension of the articulated flat plate and thereby conversion of the articulated flat plate from the folded storage condition to the flat deployed condition;

(e) said auxiliary lever including first and second leg portions rigidly attached to one another and extending in a transverse relationship with one another.

2. The tool of claim 1 wherein said main lever includes an elongated rigid member.

3. The tool of claim 2 wherein said main lever also includes a hand grip installed over an upper end of said elongated rigid member.

4. An erecting tool for use in converting an articulated flat plate from a partially folded storage condition to a flat deployed condition, said erecting tool comprising:

(a) an elongated main lever adapted to be placed at and pivoted about a stationary location on a support structure toward and away from the articulated flat plate;

(b) an extension arm rigidly attached to and extending outwardly from a lower portion of said main lever;

(c) a hook member having an upper end pivotally coupled to an outer end of said extension arm, said hook member extending therebelow and also having a lower end shaped to hook under an outer edge of the articulated flat plate and to begin lifting of the articulated flat plate upon pivoting of said main lever in a rearward direction; and (d) an auxiliary lever pivotally attached to said extension arm adjacent to and inwardly from said hook member, said auxiliary lever being depressable and said main lever and extension arm therewith being pivotal toward the articulated flat plate such that said hook member causes forward extension of the articulated flat plate and thereby conversion of the articulated flat plate from the folded storage condition to the flat deployed condition;

(e) said main lever including an elongated rigid member and a cup-shaped slip resistant element installed over a lower end of said elongated rigid member.

5. The tool of claim 1 wherein said extension arm extends outwardly in a cantilevered relationship from said main lever.

6. The tool of claim 1 wherein said auxiliary lever is pivotally connected at one of said first and second leg portions thereof to said extension arm.

7. An erecting tool for use in converting an articulated flat plate from a folded stored condition to a flat deployed condition, said erecting tool comprising:

(a) an elongated main lever including an elongated rigid member, a hand grip installed over an upper end of said elongated rigid member and a cup-shaped slip resistant element installed over a lower end of said elongated rigid member, said main lever thereby being adapted at said lower end to be removably placed at a stationary location on a support structure and at said upper end to be gripped to manually pivot said main lever in forward and rearward directions about a pivotal axis relative to the support structure toward and away from the articulated flat plate;

(b) an extension arm attached at an inner end to said main lever spaced above said lower end thereof and extending outwardly therefrom to an outer end;

(c) a hook member pivotally coupled at an upper end to said outer end of said extension arm and extending therebelow, said hook member having a lower end shaped for hooking under an outer edge of the articulated flat plate and to begin lifting of the articulated flat plate by pivoting said main lever in said rearward direction; and (d) an auxiliary lever pivotally attached to said extension arm adjacent to and inwardly from said hook member, said auxiliary lever being depressable and said main lever and extension arm therewith being pivotal toward the articulated flat plate such that said hook member causes forward extension of the articulated flat plate and thereby conversion of the articulated flat plate from the folded storage condition to the flat deployed condition;

(e) said auxiliary lever including first and second leg portions rigidly attached to one another and extending in a transverse relationship with one another.

8. The tool of claim 7 wherein said extension arm extends outwardly in a cantilevered relationship from said main lever.

9. The tool of claim 7 wherein said auxiliary lever is pivotally connected at one of said first and second leg portions thereof to said extension arm.

10. The tool of claim 7 wherein said rigidly attached first and second leg portions define an elbow for engaging the articulated flat plate, said second leg portion being pivotally connected to said extension arm.

11. An erecting tool for use in converting an articulated flat plate from a folded storage condition to a flat deployed condition, the articulated flat plate having a rear portion hingedly attached on a support structure to undergo pivotal movement toward and away from the support structure about a first pivotal axis, the articulated flat plate also having a forward portion hingedly connected to the front edge of the rear portion to undergo pivotal movement relative thereto about a second pivotal axis oriented in a substantially parallel relationship to the first pivotal axis, the forward portion of the articulated flat plate hanging downwardly from the front edge of the rear portion thereof in a partially folded relationship therewith and extendable outwardly therefrom in an extended flat relationship therewith, said erecting tool comprising:

(a) an elongated main lever adapted at a lower end to be removably placed at a stationary location on the support structure and manually pivotable about a third pivotal axis relative to the support structure toward and away from the articulated flat plate in forward and rearward directions lying along a plane extending in a substantially perpendicular relationship to the first and second pivotal axes of the front and rear portions of the articulated flat plate;

(b) an extension arm attached at an inner end to said main lever spaced above said lower end thereof and extending outwardly therefrom to an outer end;

(c) a hook member pivotally coupled at an upper end to said outer end of said extension arm and extending therebelow, said hook member having a lower end shaped for hooking under an outer edge of the front portion of the articulated flat plate and to begin lifting of the rear and front portions thereof by pivoting said main lever along said plane in said rearward direction; and (d) an auxiliary lever attached to said extension arm adjacent to and inwardly from said outer end thereof, said auxiliary lever being depressable and said main lever and extension arm therewith being pivotal along said plane in a forward direction toward the articulated flat plate such that said hook member causes pivoting of the front and rear portions of the articulated flat plate relative to one another from the partially folded relationship to the extended flat relationship and thereby forward extension of the articulated flat plate and conversion thereof from the folded storage condition to the flat deployed condition;

(e) said auxiliary lever including first and second leg portions rigidly attached to one another and extending in a transverse relationship with one another.

12. The tool of claim 11 wherein said main lever includes an elongated rigid member.

13. The tool of claim 12 wherein said main lever also includes a hand grip installed over an upper end of said elongated rigid member.

14. An erecting tool for use in converting an articulated flat plate from a folded storage condition to a flat deployed condition, the articulated flat plate having a rear portion hingedly attached on a support structure to undergo pivotal movement toward and away from the support structure about a first pivotal axis, the articulated flat plate also having a forward portion hingedly connected to the front edge of the rear portion to undergo pivotal movement relative thereto about a second pivotal axis oriented in a substantially parallel relationship to the first pivotal axis, the forward portion of the articulated flat plate hanging downwardly from the front edge of the rear portion thereof in a partially folded relationship therewith and extendable outwardly therefrom in an extended flat relationship therewith, said erecting tool comprising:

(a) an elongated main lever adapted at a lower end to be removably placed at a stationary location on the support structure and manually, pivotable abmut a third pivotal axis relative to the support structure toward and away from the articulated flat plate in forward and rearward directions lying along a plane extending in a substantially perpendicular relationship to the first and second pivotal axes of the front and rear portions of the articulated flat plate;

(b) an extension arm attached at an inner end to said main lever spaced above said lower end thereof and extending outwardly therefrom to an outer end;

(c) a hook member pivotally coupled at an upper end to said outer end of said extension arm and extending therebelow, said hook member having a lower end shaped for hooking under an outer edge of the front portion of the articulated flat plate and to begin lifting of the rear and front portions thereof by pivoting said main lever along said plane in said rearward direction; and (d) an auxiliary lever attached to said extension arm adjacent to and inwardly from said outer end thereof, said auxiliary lever being depressable and said main lever and extension arm therewith being pivotal along said plane in a forward direction toward the articulated flat plate such that said hook member causes pivoting of the front and rear portions of the articulated flat plate relative to one another from the partially folded relationship to the extended flat relationship and thereby forward extension of the articulated flat plate and conversion thereof from the folded storage condition to the flat deployed condition;

(e) said main lever including an elongated rigid member and a cup-shaped slip resistant element installed over a lower end of said elongated rigid member.

15. The tool of claim 11 wherein said extension arm extends outwardly in a cantilevered relationship from said main lever.

16. The tool of claim 11 wherein said auxiliary lever is pivotally connected at one of said first and second leg portions thereof to said extension arm.

17. The tool of claim 11 wherein said rigidly attached first and second leg portions define an elbow for engaging the articulated flat plate, said second leg portion being pivotally connected to said extension arm.

* * * * *